US011897027B2

(12) United States Patent
Niitsuma et al.

(10) Patent No.: US 11,897,027 B2
(45) Date of Patent: Feb. 13, 2024

(54) IMMERSION NOZZLE FOR CONTINUOUS CASTING

(71) Applicant: SHINAGAWA REFRACTORIES CO., LTD, Tokyo (JP)

(72) Inventors: Hiroyasu Niitsuma, Tokyo (JP); Keigo Fujita, Tokyo (JP)

(73) Assignee: SHINAGAWA REFRACTORIES CO., LTD, Tokyo (JP)

( * ) Notice: Subject to any disclaimer, the term of this patent is extended or adjusted under 35 U.S.C. 154(b) by 0 days.

(21) Appl. No.: 18/039,825

(22) PCT Filed: Mar. 3, 2022

(86) PCT No.: PCT/JP2022/009018

§ 371 (c)(1),
(2) Date: Jun. 1, 2023

(87) PCT Pub. No.: WO2022/219956

PCT Pub. Date: Oct. 20, 2022

(65) Prior Publication Data

US 2023/0347406 A1 Nov. 2, 2023

(30) Foreign Application Priority Data

Apr. 15, 2021 (JP) ..... 2021-069066

(51) Int. Cl.
*B22D 11/10* (2006.01)
*B22D 41/50* (2006.01)

(52) U.S. Cl.
CPC ..... *B22D 11/10* (2013.01); *B22D 41/50* (2013.01)

(58) Field of Classification Search
None
See application file for complete search history.

(56) References Cited

U.S. PATENT DOCUMENTS 5,785,880 A 7/1998 Heaslip et al.
2003/0201587 A1 10/2003 Ohtsuka et al.
2019/0232364 A1* 8/2019 Higa ..... B22D 41/50

FOREIGN PATENT DOCUMENTS

CN 1453085 11/2003
EP 1 854 571 11/2007
(Continued)

OTHER PUBLICATIONS

International Search Report dated May 24, 2022 in International (PCT) Application No. PCT/JP2022/009018.

*Primary Examiner* — Scott R Kastler
(74) *Attorney, Agent, or Firm* — Wenderoth, Lind & Ponack, L.L.P.

(57) ABSTRACT

The cross-sectional shape of a flow passage 31 is circular in a first portion 3; the shape of a flow passage 51 is a flat shape in a second portion 5; in a connecting portion 4, the shape of a flow passage 41 is a shape continuously connecting the flow passage 31 of the first portion 3 and the flow passage 51 of the second portion 5; an opening 52 is provided on the distal end side of the second portion 5 and extends along a plane direction of the flat shape; and assuming that a maximum value of a cross-sectional area of the flow passage 31 in the first portion 3 is given by $S_1$, that a maximum value of a cross-sectional area of the flow passage 51 in the second portion 5 is given by $S_2$, and that a minimum value of a cross-sectional area of the flow passage 31 within a range of 20% of a length $L_1$ of the first portion 3 from a boundary portion 42 between the first portion 3 and the connecting portion 4 toward the upstream side is given by $S_3$, $S_2$ is greater than $S_1$, the ratio $S_1/S_3$ between $S_1$ and $S_3$ is 1.10 or more and 2.00 or less, and the ratio $S_2/S_3$ between $S_2$ and $S_3$ is 1.20 or more and 2.50 or less.

6 Claims, 3 Drawing Sheets

(56) References Cited

FOREIGN PATENT DOCUMENTS

| | | |
|---|---|---|
| JP | 62-197252 | 8/1987 |
| JP | 7-236953 | 9/1995 |
| JP | 11-47897 | 2/1999 |
| JP | 11-123509 | 5/1999 |
| JP | 2001-501132 | 1/2001 |
| JP | 2001-300699 | 10/2001 |
| WO | 98/14292 | 4/1998 |

* cited by examiner

IMMERSION NOZZLE FOR CONTINUOUS CASTING

TECHNICAL FIELD

The present invention relates to an immersion nozzle for continuous casting. The immersion nozzle according to the present invention is particularly suitable for continuous casting of slabs having a mold thickness of less than 200 mm.

BACKGROUND ART

In recent years, in order to eliminate the rolling process, continuous casting of slabs having a mold thickness of 200 mm or less (called thin slabs or medium thickness slabs) has been introduced. Following this, an immersion nozzle having a flat discharge portion (hereinafter referred to as a flat nozzle) has been employed instead of a conventional cylindrical immersion nozzle (hereinafter referred to as a cylindrical nozzle). However, the flat nozzle has a problem that, compared to the conventional cylindrical nozzle, drift generated when molten steel passes through a stopper, a sliding nozzle, or the like located upstream of the flat nozzle is hard to calm down. Therefore, molten steel in a mold becomes non-uniform to cause the degradation of steel quality. In view of this, in order to solve this problem, various flat nozzles aimed at restraining the drift have been devised.

Patent Literature 1 and Patent Literature 2 disclose a nozzle in which the upstream side is formed generally cylindrical and the downstream side is formed flat. Patent Literature 3 discloses an example where, in a nozzle in which the outlet side is formed flat, a molten steel stirring portion formed by a diameter increased portion and a diameter reduced portion is illustrated on the inlet side.

CITATION LIST

Patent Literature

Patent Literature 1: Japanese Unexamined Patent Application Publication No. 11-47897

Patent Literature 2: Japanese Unexamined Patent Application Publication (Translation of PCT Application) No. 2001-501132 (or U.S. Pat. No. 5,785,880)

Patent Literature 3: Japanese Unexamined Patent Application Publication No. 2001-300699

SUMMARY OF INVENTION

Technical Problem

However, with these prior arts, the drift cannot be sufficiently restrained. In Patent Literature 1 and Patent Literature 2, while the drift in the cylindrical portion on the upstream side is somewhat relieved, the drift of molten steel flow discharged cannot be satisfactorily restrained even by providing the flat portion on the downstream side. In the case of the nozzle of Patent Literature 3, the production yield is poor due to its complex shape, and further, the bending stress is concentrated on the boundary between the diameter increased portion and the diameter reduced portion so that cracks are prone to occur.

Therefore, the technical problem is to provide an immersion nozzle for continuous casting which has a relatively simple structure and in which the flow of molten steel in the nozzle is optimized. Consequently, the quality and the productivity of cast pieces are improved.

Solution to Problem

Fluid analysis was performed on the flow of molten steel in a flat nozzle, and as a result, it has been revealed that when, in a portion where the cross-sectional shape of an inner tube of the flat nozzle transitions from a circular shape to a flat shape, the inner diameter is narrowed at least partially at a portion where the cross-sectional shape is circular, so as to once collect the flow to a central portion of the inner tube to rectify the flow, it is easy to cause the flow to be evenly distributed to left and right at the time of the transition to the flat shape thereafter. It has also been confirmed that, in order to moderate an increase in flow velocity generated by once narrowing the inner diameter, it is effective to set the cross-sectional area of the inner tube in the vicinity of a discharge hole to 1.20 times or more the cross-sectional area of the narrowed portion. Based on these knowledge, optimization of the shapes of respective portions of the flat nozzle was performed.

An immersion nozzle for continuous casting according to the present invention is an immersion nozzle for continuous casting including: a flow passage; an opening; a first portion; a connecting portion; and a second portion, the first section, the connecting section, and the second section being arranged in this order from a proximal end side of the immersion nozzle, wherein: a cross-sectional shape of the flow passage is circular in the first portion; a shape of the flow passage is a flat shape in the second portion; in the connecting portion, a shape of the flow passage is a shape continuously connecting the flow passage of the first portion and the flow passage of the second portion; the opening is in a portion of the second portion proximate to a distal end and extends along a plane direction of the flat shape; and assuming that a maximum value of a cross-sectional area of the flow passage in the first portion is given by $S_1$, that a maximum value of a cross-sectional area of the flow passage in the second portion is given by $S_2$, and that a minimum value of a cross-sectional area of the flow passage within a range of 20% of a length of the first portion from a boundary portion between the first portion and the connecting portion toward an upstream side is given by $S_3$, $S_2$ is greater than $S_1$, a ratio $S_1/S_3$ between $S_1$ and $S_3$ is 1.10 or more and 2.00 or less, and a ratio $S_2/S_3$ between $S_2$ and $S_3$ is 1.20 or more and 2.50 or less.

With this configuration, the flow of molten steel in the nozzle can be optimized while the structure of the nozzle is made relatively simple. First, a portion where the inner diameter of the flow passage is narrowed at least partially is provided at a lower end of the generally cylindrical first portion, and therefore the molten steel flow tends to be rectified before flowing into the connecting portion. Second, the maximum value of the cross-sectional area of the flow passage in the second portion is set to be greater than the minimum value of the cross-sectional area of the flow passage in the portion with the narrowed inner diameter, and therefore the flow velocity of the molten steel flow is suitably reduced in the second portion and the molten steel flow tends to be evenly supplied to the left and right of the nozzle.

Hereinafter, preferred aspects of the present invention will be described. However, the scope of the present invention is not limited by preferred aspect examples described below.

As one aspect, in the immersion nozzle for continuous casting according to the present invention, it is preferable that the ratios of the respective lengths of the first portion, the second portion, and the connecting portion to the total length of the immersion nozzle be all 10% or more.

With this configuration, both the effect of restraining the drift and the effect of reducing the flow velocity of the molten steel flow are easy to obtain on sufficient levels.

As one aspect, in the immersion nozzle for continuous casting according to the present invention, it is preferable that the width of the flow passage in the second portion be 300 mm or less.

With this configuration, the effect of reducing the flow velocity of the molten steel flow is easy to obtain on a sufficient level.

As one aspect, it is preferable that the immersion nozzle for continuous casting according to the present invention further include a joining portion connected to a portion of the first portion on the proximal end side, wherein the cross-sectional area of the flow passage gradually decreases from the proximal end side to the distal end side of the joining portion.

With this configuration, when stopper flow control is employed, it is possible to eliminate a joint being a cause of the intake that oxidizes molten steel from a tundish to a mold, and therefore the quality of steel tends to improve.

Further features and advantages of the present invention will become clearer from the following description of exemplary and non-limiting embodiments given with reference to the drawings.

DESCRIPTION OF EMBODIMENTS

An embodiment of an immersion nozzle for continuous casting according to the present invention will be described with reference to the drawings. Hereinafter, a description will be given of an example in which the immersion nozzle for continuous casting according to the present invention is applied to an immersion nozzle for continuous casting 1 (hereinafter simply referred to as the nozzle 1) used for continuous casting of slabs having a mold thickness of 200 mm or less.

[Overall Configuration of Immersion Nozzle for Continuous Casting]

Figure 1:
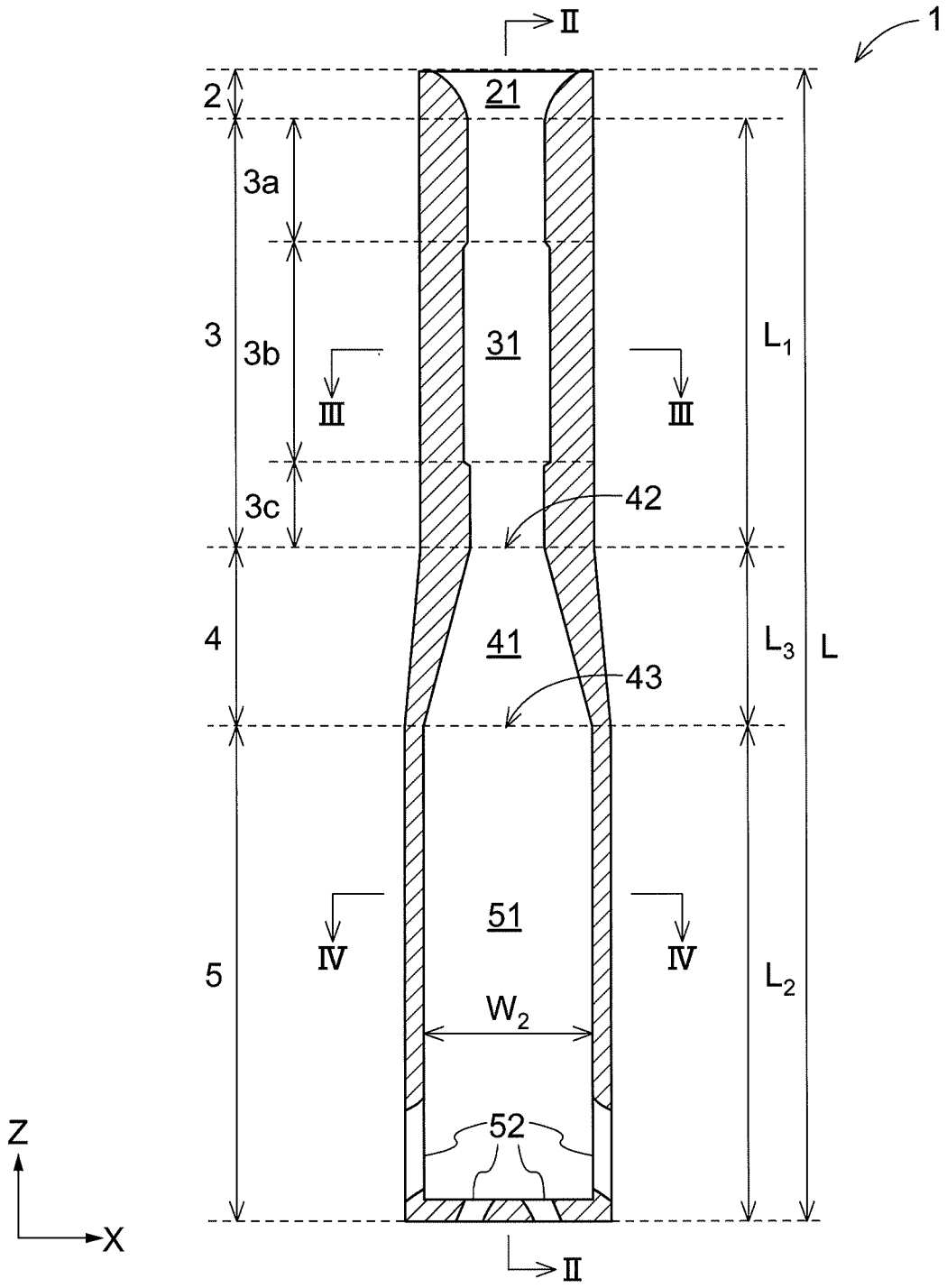
FIG. 1 is a front sectional view of an immersion nozzle for continuous casting according to an embodiment.
Figure 2:
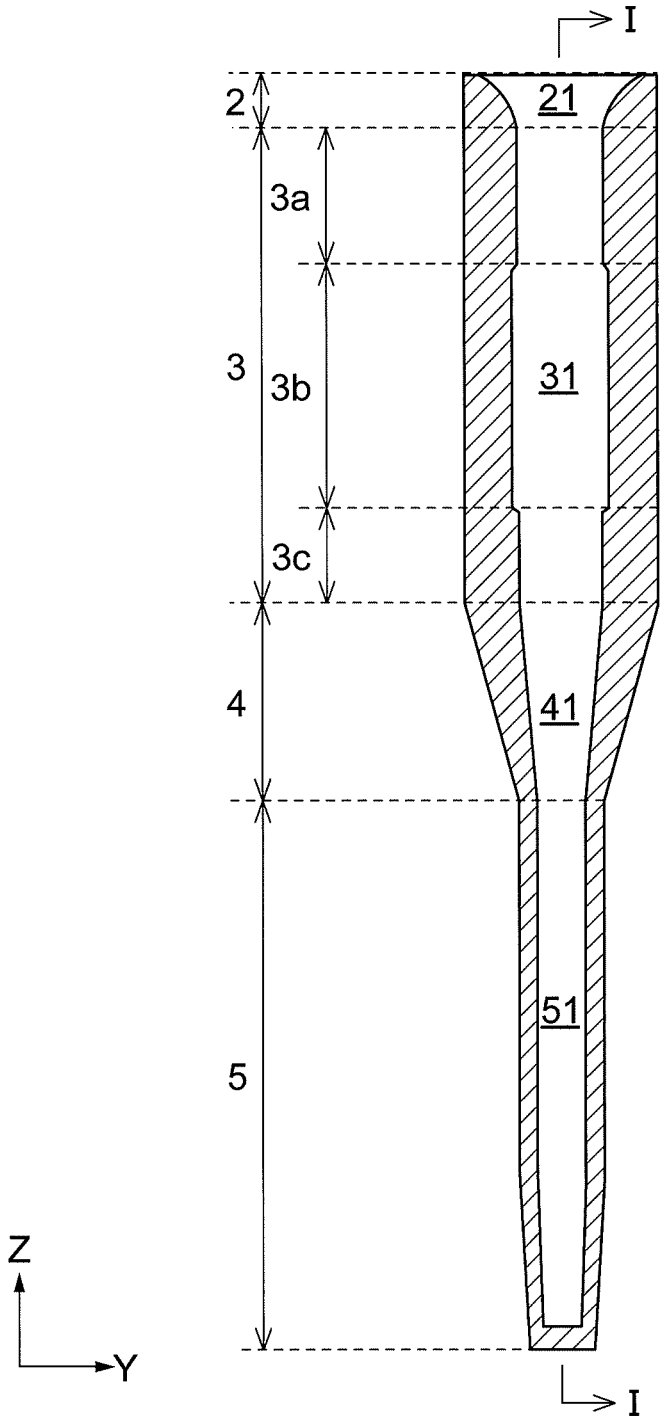
FIG. 2 is a side sectional view of the immersion nozzle for continuous casting according to the embodiment.

The nozzle 1 is a tubular member formed of a refractory material. A flow passage for allowing molten steel to flow therethrough is formed inside the nozzle 1, and openings are provided in a distal end portion of the nozzle 1. The nozzle 1 is provided with a joining portion 2, a first portion 3, a connecting portion 4, and a second portion 5 in this order from the proximal end side of the nozzle 1, and the shapes of the respective portions differ from each other (FIGS. 1 and 2). At the joining portion 2, the nozzle 1 is joined to upstream equipment (stopper, sliding nozzle, or the like, not illustrated). A total length L of the nozzle 1 is 1200 mm. Although there are cases where descriptions about the lengths of the respective portions of the nozzle 1 given below and their forms illustrated in FIGS. 1 and 2 differ from each other, this is because, in order to emphatically illustrate the structures of the respective portions of the nozzle 1, the illustration is given by changing the vertical lengths thereof in FIGS. 1 and 2. Therefore, the lengths of the respective portions should be interpreted based on the descriptions given below.

The type of refractory material forming the nozzle 1 is not particularly limited, and it is possible to use a refractory material conventionally used in this field. As such a refractory material, alumina-graphite refractory, magnesia-graphite refractory, spinel-graphite refractory, zirconia-graphite refractory, calcium-zirconate graphite refractory, high-alumina refractory, alumina-silica refractory, silica refractory, zircon refractory, spinel refractory, and the like are exemplified. Further, zone lining may be applied as appropriate.

When referring to the direction in the following description, the arrangement illustrated in FIG. 1 is used as a reference. Specifically, when referring to the vertical direction, the proximal end side (the joining portion 2 side) is referred to as upper (upper portion, upward, upper side, upstream, etc.), and the distal end side (the second portion 5 side) is referred to as lower (lower portion, downward, lower side, downstream, etc.). When referring to the length of the entire nozzle 1 or a part thereof, the length in the vertical direction defined above is referred to unless otherwise specified.

When referring to a section of the flow passage, a section in a direction perpendicular to the vertical direction defined above (a direction perpendicular to the sheet surface of FIG. 1) is referred to unless otherwise specified, and this section is referred to as a cross section. In use of the nozzle 1, molten steel flows from the upper side to the lower side defined above, and therefore the cross section defined above is also a section with respect to the flow direction of molten steel.

[Configuration of First Portion]

The first portion 3 is a main portion of the nozzle 1 on the proximal end side. In this embodiment, a length $L_1$ of the first portion 3 is 300 mm, and thus the ratio of the length $L_1$ of the first portion 3 to the total length L of the nozzle 1 is 25% (FIG. 1).

Figure 3:
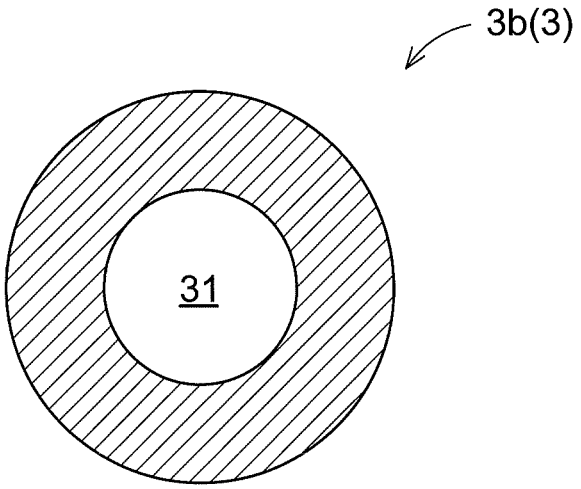
FIG. 3 is a cross-sectional view of a first portion of the immersion nozzle for continuous casting according to the embodiment.

In the first portion 3, the cross-sectional shape of a flow passage 31 is circular (FIGS. 1 to 3). In this embodiment, the area of the cross section of the first portion 3 is not constant, i.e., the cross-sectional area of the flow passage 31 is 3850 $mm^2$ in a first-portion upper portion 3*a*, the cross-sectional area of the flow passage 31 is 5000 $mm^2$ in a first-portion middle portion 3*b*, and the cross-sectional area of the flow passage 31 is 3700 $mm^2$ in a first-portion lower portion 3*c*. In a boundary portion between the first-portion upper portion 3*a* and the first-portion middle portion 3*b* where the cross-sectional areas of the flow passage 31 differ from each other, the flow passage 31 is formed in a tapered shape the diameter of which changes continuously. Also in a boundary portion between the first-portion middle portion 3*b* and the first-portion lower portion 3*c*, the flow passage 31 is formed in a tapered shape.

In this embodiment, the cross-sectional area of the flow passage 31 of the first portion 3 is maximized in the first-portion middle portion 3*b*. Herein, the maximum value of the cross-sectional area of the flow passage 31 in the first portion 3 is given by $S_1$, and in this embodiment, $S_1$ is 5000 $mm^2$ (the cross-sectional area of the flow passage 31 in the first-portion middle portion 3*b*).

The first-portion lower portion 3*c* is continuously connected to the connecting portion 4, and a length $L_{1c}$ is 60 mm. Therefore, the length $L_{1c}$ of the first-portion lower portion 3*c* is 20% of the length $L_1$ of the first portion 3. Herein, the minimum value of the cross-sectional area of the flow passage 31 in the first-portion lower portion 3*c* is given by $S_3$, and in this embodiment, $S_3$ is 3700 $mm^2$. Herein, the minimum value of the cross-sectional area of the flow passage 31 in the first-portion lower portion 3*c* is an example of the minimum value of the cross-sectional area of the flow passage within a range of 20% of the length of the first portion from a boundary portion between the first portion and the connecting portion toward the upstream side. In this embodiment, since the flow passage 31 in the first-portion lower portion 3*c* is formed cylindrical except the tapered portion where the first-portion lower portion 3*c* is connected to the first-portion middle portion 3*b*, $S_3$ is equal to the cross-sectional area of the flow passage 31 of the first-portion lower portion 3*c* in a portion other than the tapered portion of the first-portion lower portion 3*c*.

[Configuration of Second Portion]

The second portion 5 is a main portion of the nozzle 1 on the distal end side. In this embodiment, a length $L_2$ of the second portion 5 is 600 mm, and thus the ratio of the length $L_2$ of the second portion 5 to the total length L of the nozzle 1 is 50% (FIG. 1).

Figure 4:
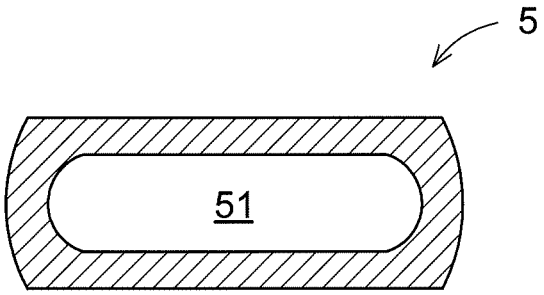
FIG. 4 is a cross-sectional view of a second portion of the immersion nozzle for continuous casting according to the embodiment.

In the second portion 5, the shape of a flow passage 51 is flat (FIGS. 1, 2, and 4). With respect to the flat shape of the flow passage 51, the XZ-plane direction in FIG. 1 is defined as a "plane direction", and the Y-axis direction in FIG. 2 is defined as a "thickness direction". Herein, the flat shape is not particularly limited within a range recognized to be flat by those skilled in the art, and, for example, refers to a shape in which a width $W_2$ (the X-axis direction in FIG. 1) of the flow passage 51 is 1.5 times or more the thickness (the Y-axis direction in FIG. 2) of the flow passage 51.

Openings 52 are each in a portion of the flow passage 51 proximal to the distal end. In this embodiment, the four openings 52 are provided, the two of which are provided in a surface at the distal end in the longitudinal direction of the nozzle 1 and the remaining two of which are respectively provided in longitudinal-direction side surfaces of the nozzle 1. Each of the openings 52 extends in the plane direction (the XZ-plane direction in FIG. 1) of the flat shape of the flow passage 51. While the number of the openings 52 provided is not particularly limited, it is preferable that each of the openings 52 be provided along the plane direction of the flat shape of the flow passage 51.

In this embodiment, the cross-sectional area of the flow passage 51 is constant in a range in which the opening 52 is not provided, and is 5400 $mm^2$. Therefore, in this embodiment, a maximum value $S_2$ of the cross-sectional area of the flow passage 51 in the second portion 5 is 5400 $mm^2$. The cross-sectional area of the flow passage 51 is not necessarily constant, but in this case, it is preferable to configure that a boundary portion between regions having different cross-sectional areas be formed in a tapered shape in which the cross-sectional area changes continuously along the longitudinal direction of the second portion 5.

In this embodiment, the width $W_2$ of the flow passage 51 is also constant in the range in which the opening 52 is not provided, and is 300 mm. The width $W_2$ of the flow passage 51 is preferably 300 mm or less.

[Configuration of Connecting Portion]

The connecting portion 4 is a portion continuously connecting the first portion 3 and the second portion 5. In this embodiment, a length $L_3$ of the connecting portion 4 is 250 mm, and thus the ratio of the length $L_3$ of the connecting portion 4 to the total length L of the nozzle 1 is 21% (FIG. 1).

The connecting portion 4 is provided with a flow passage 41 having a shape continuously connecting the flow passage 31 of the first portion 3 having the circular cross-sectional shape and the flow passage 51 of the second portion 5 having the flat cross-sectional shape. Therefore, the cross-sectional shape of the flow passage 41 is circular at an upper end 42 and flat at a lower end 43. The cross-sectional area of the flow passage 41 at the boundary between the first portion 3 and the connecting portion 4 (i.e., at the upper end 42 of the connecting portion 4) is equal to the cross-sectional area of the flow passage 31 in the first-portion lower portion 3*c*, and is 3700 $mm^2$.

[Configuration of Joining Portion]

The joining portion 2 is a portion for joining the nozzle 1 to the upstream equipment (stopper, sliding nozzle, or the like, not illustrated). The joining portion 2 is configured such that the cross-sectional area of a flow passage 21 gradually decreases from the proximal end side to the distal end side (i.e., the first portion 3 side). With the joining portion 2 provided in the nozzle 1, when stopper flow control is employed, it is possible to eliminate a joint being a cause of the intake that oxidizes molten steel from a tundish to a mold, and therefore the quality of steel tends to improve.

[Dimensional Relationship of Respective Portions]

Subsequently, the dimensional relationship of the first portion 3, the connecting portion 4, and the second portion 5 will be described.

As described above, to the total length L of the nozzle 1, the ratio of the length $L_1$ of the first portion 3 is 25%, the ratio of the length $L_3$ of the connecting portion 4 is 21%, and the ratio of the length $L_2$ of the second portion 5 is 50%. In this way, it is preferable that the ratios of the lengths of the first portion 3, the connecting portion 4, and the second portion 5 to the total length L of the nozzle 1 each be 10% or more. In particular, it is more preferable that the ratio of the length $L_2$ of the second portion 5 to the total length L of the nozzle 1 be 20% or more.

The maximum value $S_1$ of the cross-sectional area of the flow passage 31 in the first portion 3 is 5000 $mm^2$, and the maximum value $S_2$ of the cross-sectional area of the flow passage 51 in the second portion 5 is 5400 $mm^2$. Therefore, $S_2$ is greater than $S_1$.

Since the maximum value $S_1$ of the cross-sectional area of the flow passage 31 in the first portion 3 is 5000 $mm^2$ and the minimum value $S_3$ of the cross-sectional area of the flow passage 31 in the first-portion lower portion 3*c* is 3700 $mm^2$, the ratio $S_1/S_3$ between $S_1$ and $S_3$ is 1.35. In this embodiment, the ratio $S_1/S_3$ between $S_1$ and $S_3$ is in a range of 1.10 or more and 2.00 or less. The ratio $S_1/S_3$ between $S_1$ and $S_3$ is preferably 1.15 or more and more preferably 1.25 or more. Further, the ratio $S_1/S_3$ between $S_1$ and $S_3$ is preferably 1.90 or less and more preferably 1.80 or less.

Since the maximum value $S_2$ of the cross-sectional area of the flow passage 51 in the second portion 5 is 5400 $mm^2$ and the minimum value $S_3$ of the cross-sectional area of the flow passage 31 in the first-portion lower portion 3*c* is 3700 $mm^2$, the ratio $S_2/S_3$ between $S_2$ and $S_3$ is 1.46. In this embodiment, the ratio $S_2/S_3$ between $S_2$ and $S_3$ is in a range of 1.20 or more and 2.50 or less. The ratio $S_2/S_3$ between $S_2$ and $S_3$ is preferably 1.25 or more and more preferably 1.30 or more. Further, the ratio $S_2/S_3$ between $S_2$ and $S_3$ is preferably 2.40 or less and more preferably 2.20 or less.

OTHER EMBODIMENTS

Finally, other embodiments of the immersion nozzle for continuous casting according to the present invention will be described. The configurations disclosed in the following respective embodiments can also be applied in combination with the configurations disclosed in the other embodiments unless a discrepancy occurs.

Any of the first portion, the connecting portion, and the second portion of the immersion nozzle for continuous casting according to the present invention are not limited to the structures of the first portion 3, the connecting portion 4, and the second portion 5 exemplified above, and a known change for providing a specific function may be added to the structure of each of the portions. For example, a drift prevention measure such as a diameter increased portion and a diameter reduced portion, a step, an uneven portion, or a groove can be provided in any of the first portion, the connecting portion, and the second portion.

In the embodiment described above, the configuration in which the joining portion 2 is provided in the end portion on the proximal end side of the nozzle 1 has been described by way of example. However, the joining portion is not necessarily provided on the proximal end side of the immersion nozzle for continuous casting according to the present invention. In this case, the end portion on the proximal end side of the immersion nozzle for continuous casting is the first portion, and therefore its flow passage is configured to be generally cylindrical (the cross-sectional area is approximately constant).

In the embodiment described above, the configuration in which the flow passage 31 in the first-portion lower portion 3*c* is formed cylindrical except the tapered portion at the upper end has been described by way of example. However, in the present invention, the shape of the flow passage in the first-portion lower portion is not limited as long as the cross-sectional shape of the flow passage is circular. For example, it is possible to employ a configuration in which a local diameter reduced portion is provided midway of the flow passage of the first-portion lower portion, a configuration in which the flow passage of the first-portion lower portion formed in a tapered shape, or the like. Further, in the embodiment described above, the configuration in which the length $L_{1c}$ of the first-portion lower portion 3*c* is 20% of the length $L_1$ of the first portion 3 has been described by way of example, but the length of the first-portion lower portion is arbitrary. In any case, the minimum value of the cross-sectional area of the flow passage within the range of 20% of the length of the first portion from the boundary portion between the first portion and the connecting portion toward the upstream side is defined as $S_3$. Herein, even when a portion narrowing the cross-sectional area of the flow passage is provided outside the range described above, i.e., at a position away from the boundary portion beyond 20% of the length of the first portion, the effect of preventing the drift is hard to obtain.

In the embodiment described above, the invention has been described in which the minimum value of the cross-sectional area of the flow passage 31 in the first-portion lower portion 3*c* is given by $S_3$, the ratio $S_1/S_3$ between $S_1$ and $S_3$ is in the range of 1.10 or more and 2.00 or less, and the ratio $S_2/S_3$ between $S_2$ and $S_3$ is in the range of 1.20 or more and 2.50 or less. However, as another aspect of the present invention, it is possible to specify an invention in which the cross-sectional area of the flow passage at the boundary between the first portion and the connecting portion is defined as $S_3$, and the ratio $S_1/S_3$ between $S_1$ and $S_3$ and the ratio $S_2/S_3$ between $S_2$ and $S_3$ are respectively in the numerical ranges described above. Specifically, another aspect of the present invention is an immersion nozzle for continuous casting including: a flow passage; an opening; a first portion; a connecting portion; and a second portion, the first portion, the connecting portion, and the second portion being arranged in this order from the proximal end side of the immersion nozzle, wherein: the cross-sectional shape of the flow passage is circular in the first portion; the shape of the flow passage is a flat shape in the second portion; in the connecting portion, the shape of the flow passage is a shape continuously connecting the flow passage of the first portion and the flow passage of the second portion; the opening is in a portion of the second portion proximate to a distal end and extends along a plane direction of the flat shape; and assuming that the maximum value of the cross-sectional area of the flow passage in the first portion is given by $S_1$, that the maximum value of the cross-sectional area of the flow passage in the second portion is given by $S_2$, and that the cross-sectional area of the flow passage at the boundary between the first portion and the connecting portion is given by $S_3$, $S_2$ is greater than $S_1$, the ratio S i/$S_3$ between $S_1$ and $S_3$ is 1.10 or more and 2.00 or less, and the ratio $S_2/S_3$ between $S_2$ and $S_3$ is 1.20 or more and 2.50 or less. Also according to this other aspect, the same actions and effects as those of the embodiment described above are exhibited.

Also with respect to the other configurations, it should be understood that the embodiments disclosed in this description are illustrative in all aspects and thus the scope of the present invention is not limited by them. Those skilled in the art can easily understand that modifications are made possible as appropriate in a range not departing from the gist of the present invention. Therefore, other embodiments modified in the range not departing from the gist of the present invention are also naturally included in the scope of the present invention.

EXAMPLES

Hereinafter, the present invention will be further described by giving Examples. However, the present invention is not limited by the Examples given below.

[Nozzle Shape]

Nozzles were produced by changing the following conditions. The conditions selected in each of examples are described in tables given later.

(Magnitude Relationship of $S_1$ and $S_2$)

Examples in which $S_2>S_1$ like in the embodiment described above, and examples in which $S_1>S_2$ contrary to the embodiment described above were produced.

(Ratio $S_1/S_3$ between $S_1$ and $S_3$)

Examples in which the ratio $S_1/S_3$ between $S_1$ and $S_3$ was changed in a range of 1.00 to 2.10 were produced.

(Ratio $S_2/S_3$ between $S_2$ and $S_3$)

Examples in which the ratio $S_2/S_3$ between $S_2$ and $S_3$ was changed in a range of 0.75 to 2.80 were produced.

(Width $W_2$ of Second Portion 5)

Examples in which the width $W_2$ of the second portion 5 was set to 300 mm like in the embodiment described above, and an example in which the width $W_2$ was set to 320 mm different from that in the embodiment described above were produced.

[Evaluation]

A water model test was conducted for the nozzles of the examples of Examples and Comparative Examples. The mold size was set to 1200×1400 mm, and the throughput was set to 4.0 tons per minute in terms of molten steel. With respect to water discharged from each of the nozzles, the meniscus flow velocity and the difference of water surface variations on the left and right of the nozzle were measured for 3 minutes, and the average value and the temporal change were recorded.

(Meniscus Flow Velocity)

The average value of the meniscus flow velocity for 3 minutes was evaluated in three stages of A to C. With respect to an example of the evaluation B or C, a sign of + or − was added to indicate magnitude relative to the most favorable range (the range of the evaluation A). The evaluation B or higher is favorable in actual use, and the evaluation A is particularly favorable.

A: The average value of the meniscus flow velocity for 3 minutes is 20 cm or more and 30 cm or less per second.

B(−): The average value of the meniscus flow velocity for 3 minutes is 10 cm or more and less than 20 cm per second.

B(+): The average value of the meniscus flow velocity for 3 minutes is more than 30 cm and 40 cm or less per second.

C(−): The average value of the meniscus flow velocity for 3 minutes is less than 10 cm per second.

C(+): The average value of the meniscus flow velocity for 3 minutes is more than 40 cm per second.

(Difference of Left and Right Water Surface Variations)

The difference of water surfaces on the left and right of the nozzle was evaluated in four stages of A to C. The evaluation B or higher is favorable in actual use, and the evaluation A is particularly favorable.

A: The difference in liquid level between left and right water surfaces is constantly less than 7 mm.

B: The difference in liquid level between left and right water surfaces is constantly 7 mm or more and less than 10 mm.

C: The difference in liquid level between left and right water surfaces is constantly 10 mm or more.

[Results]

With respect to the examples of Examples and Comparative Examples, the dimensional conditions and the evaluation results are shown in Tables 1 to 3 given below. Examples 1 to 9 in which $S_2$ was greater than $S_1$ (condition 1), the ratio $S_1/S_3$ between $S_1$ and $S_3$ was 1.10 or more and 2.00 or less (condition 2), and the ratio $S_2/S_3$ between $S_2$ and $S_3$ was 1.20 or more and 2.50 or less (condition 3) were on a practically favorable level (the evaluation B or higher) for both the meniscus flow velocity and the difference of left and right water surface variations (Table 1). On the other hand, Comparative Examples 1 to 6 not satisfying at least one of the conditions 1 to 3 were given the evaluation C for either the meniscus flow velocity and the difference of left and right water surface variations and therefore were on a practically unfavorable level.

Table 3 shows examples in which the ratios of the lengths of the first portion 3, the connecting portion 4, and the second portion 5 were changed. While all the examples were on a practically favorable level (the evaluation B or higher), Examples 10 to 13 in which the ratios of the respective lengths of the first portion 3, the connecting portion 4, and the second portion 5 to the total length L of the nozzle 1 were all 10% or more were given a better evaluation compared to Examples 14 to 16 in which a portion where the ratio was less than 10% was present.

Table 1: Examples

TABLE 1

| | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|
| Magnitude Relationship of $S_1$ and $S_2$ | $S_2 > S_1$ | $S_2 > S_1$ | $S_2 > S_1$ | $S_2 > S_1$ | $S_2 > S_1$ | $S_2 > S_1$ | $S_2 > S_1$ | $S_2 > S_1$ | $S_2 > S_1$ |
| $S_1/S_3$ | 1.10 | 1.30 | 1.31 | 1.30 | 1.30 | 1.30 | 1.80 | 2.00 | 1.30 |
| $S_2/S_3$ | 1.20 | 1.35 | 1.60 | 1.80 | 2.20 | 2.50 | 2.20 | 2.50 | 1.40 |
| $W_2$ [mm] | 300 | 300 | 300 | 300 | 300 | 300 | 300 | 300 | 320 |
| Meniscus Flow Velocity | A | A | A | A | A | A | A | A | B(+) |
| Difference of Left and Right Water Surface Variations | A | A | A | A | A | A | A | A | B |

Table 2: Comparative Examples

TABLE 2

| | Comp. Ex. 1 | Comp. Ex. 2 | Comp. Ex. 3 | Comp. Ex. 4 | Comp. Ex. 5 | Comp. Ex. 6 |
|---|---|---|---|---|---|---|
| Magnitude Relationship of $S_1$ and $S_2$ | $S_1 > S_2$ | $S_1 > S_2$ | $S_2 > S_1$ | $S_2 > S_1$ | $S_2 > S_1$ | $S_2 > S_1$ |
| $S_1/S_3$ | 1.20 | 1.00 | 1.00 | 1.00 | 2.10 | 1.30 |
| $S_2/S_3$ | 0.75 | 0.90 | 1.40 | 2.80 | 2.20 | 2.80 |
| $W_2$ [mm] | 300 | 300 | 300 | 300 | 300 | 300 |
| Meniscus Flow Velocity | C(+) | C(+) | B(+) | C(−) | C(+) | C(−) |
| Difference of Left and Right Water Surface Variations | A | A | C | C | A | A |

Table 3: Examples in which the ratios of the lengths of the first portion 3, the connecting portion 4, and the second portion 5 were changed

TABLE 3

| | Ex. 10 | Ex. 11 | Ex. 12 | Ex. 13 | Ex. 14 | Ex. 15 | Ex. 16 |
|---|---|---|---|---|---|---|---|
| Magnitude Relationship of $S_1$ and $S_2$ | $S_2 > S_1$ | $S_2 > S_1$ | $S_2 > S_1$ | $S_2 > S_1$ | $S_2 > S_1$ | $S_2 > S_1$ | $S_2 > S_1$ |
| $S_1/S_3$ | 1.30 | 1.30 | 1.30 | 1.30 | 1.30 | 1.30 | 1.30 |
| $S_2/S_3$ | 1.40 | 1.40 | 1.40 | 1.40 | 1.40 | 1.40 | 1.40 |
| $W_2$ [mm] | 300 | 300 | 300 | 300 | 300 | 300 | 300 |
| $L_1/L$ [%] | 10 | 40 | 40 | 40 | 8 | 42 | 42 |
| $L_3/L$ [%] | 40 | 10 | 50 | 40 | 42 | 8 | 50 |
| $L_2/L$ [%] | 50 | 50 | 10 | 20 | 50 | 50 | 8 |
| Meniscus Flow Velocity | A | A | A | A | B(+) | B(+) | B(+) |
| Difference of Left and Right Water Surface Variations | A | A | B | A | B | B | B |

INDUSTRIAL APPLICABILITY

The present invention can be used as an immersion nozzle for continuous casting and, in particular, is particularly suitable for continuous casting of slabs having a mold thickness of less than 200 mm.

DESCRIPTION OF REFERENCE NUMERALS

1: immersion nozzle for continuous casting
2: joining portion
21: flow passage
3: first portion
3*a*: first-portion upper portion
3*b*: first-portion middle portion
3*c*: first-portion lower portion
31: flow passage
4: connecting portion
41: flow passage
42: upper end of connecting portion
43: lower end of connecting portion
5: second portion
51: flow passage
52: opening

The invention claimed is:

1. An immersion nozzle for continuous casting, comprising:
a flow passage;
an opening;
a first portion;
a connecting portion; and
a second portion,
the first portion, the connecting portion, and the second portion being arranged in this order from a proximal end side of the immersion nozzle, wherein
a cross-sectional shape of the flow passage is circular in the first portion,
a cross-sectional shape of the flow passage in the second portion is a shape having a length in a long-side direction 1.5 times or more a length in a short-side direction;
in the connecting portion, a shape of the flow passage is a shape continuously connecting the flow passage of the first portion and the flow passage of the second portion,
the opening is in a portion of the second portion proximate to a distal end, and
a maximum value of a cross-sectional area of the flow passage in the first portion is $S_1$, a maximum value of a cross-sectional area of the flow passage in the second portion is $S_2$, and a minimum value of a cross-sectional area of the flow passage within a range of 20% of a length of the first portion from a boundary portion between the first portion and the connecting portion toward an upstream side is $S_3$,
$S_2$ is greater than $S_1$,
a ratio $S_1/S_3$ between $S_1$ and $S_3$ is 1.10 or more and 2.00 or less,
a ratio $S_2/S_3$ between $S_2$ and $S_3$ is 1.20 or more and 2.50 or less,
a ratio of a length of the second portion to the total length is 8% or more and 50% or less, and
a ratio of a length of the connecting portion to the total length is 8% or more and 50% or less.

2. The immersion nozzle for continuous casting according to claim 1, wherein
a width of the flow passage in the second portion is 300 mm or less.

3. The immersion nozzle according to claim 1, further comprising:
a joining portion connected to a portion of the first portion on the proximal end side, wherein
a cross-sectional area of the flow passage gradually decreases from a proximal end side to a distal end side of the joining portion.

4. The immersion nozzle according to claim 1, wherein the opening is provided in each of two longitudinal-direction side surfaces in a distal end portion of the second portion.

5. The immersion nozzle according to claim 1, wherein the opening is provided in a surface at a distal end of the second portion.

6. The immersion nozzle according to claim 1, wherein a ratio of a length of the first portion to a total length is 8% or more and 42% or less.

* * * * *